US011454224B2

(12) United States Patent
Colby

(10) Patent No.: US 11,454,224 B2
(45) Date of Patent: Sep. 27, 2022

(54) POSITIVE DISPLACEMENT PUMP CONTROLLER AND METHOD OF OPERATION

(71) Applicant: Graco Minnesota Inc., Minneapolis, MN (US)

(72) Inventor: Bryan K. Colby, New Brighton, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 16/980,926

(22) PCT Filed: Mar. 21, 2019

(86) PCT No.: PCT/US2019/023416
§ 371 (c)(1),
(2) Date: Sep. 15, 2020

(87) PCT Pub. No.: WO2019/183383
PCT Pub. Date: Sep. 26, 2019

(65) Prior Publication Data

US 2020/0408200 A1 Dec. 31, 2020

Related U.S. Application Data

(60) Provisional application No. 62/647,406, filed on Mar. 23, 2018.

(51) Int. Cl.
*F04B 9/04* (2006.01)
*F04B 49/12* (2006.01)
(Continued)

(52) U.S. Cl.
CPC ..... *F04B 9/045* (2013.01); *F04B 17/03* (2013.01); *F04B 49/126* (2013.01); *F04B 49/20* (2013.01); *F04B 2201/1201* (2013.01)

(58) Field of Classification Search
CPC .. F04B 5/02; F04B 9/045; F04B 9/047; F04B 17/03; F04B 49/126; F04B 49/20; F04B 2201/1201
See application file for complete search history.

(56) References Cited

U.S. PATENT DOCUMENTS 5,245,962 A 9/1993 Routery
5,988,994 A * 11/1999 Berchowitz ..... F04B 35/04 417/415

(Continued)

OTHER PUBLICATIONS

International Preliminary Report on Patentability for PCT Application No. PCT/US2019/023416, dated Sep. 29, 2020, 9 pages.

(Continued)

*Primary Examiner* — Connor J Tremarche
(74) *Attorney, Agent, or Firm* — Kinney & Lange, P. A.

(57) ABSTRACT

Non-limiting exemplary embodiments of a pumping system and methods for operating the pumping system in a region of high pressure or a region of high flow are disclosed. The pumping system includes a piston disposed within a piston cylinder, a drive shaft, an eccentric coupled to the drive shaft, a connecting arm having opposing first and second ends, and a controller for controlling the rotation of the drive shaft such that the piston oscillates within a region of high pressure or a region of high flow.

21 Claims, 15 Drawing Sheets

(51) Int. Cl.
*F04B 49/20* (2006.01)
*F04B 17/03* (2006.01)

(56) References Cited

U.S. PATENT DOCUMENTS

| | | | | |
|---|---|---|---|---|
| 7,028,647 | B2 | 4/2006 | Styron | |
| 2012/0048230 | A1* | 3/2012 | Darrow | F01C 20/22 123/236 |
| 2017/0335832 | A1* | 11/2017 | Olovsson | F04B 5/02 |

OTHER PUBLICATIONS

International Search Report and Written Opinion for PCT Application No. PCT/US2019/023416, dated May 17, 2019, 17 pages.

* cited by examiner

POSITIVE DISPLACEMENT PUMP CONTROLLER AND METHOD OF OPERATION

CROSS-REFERENCE TO RELATED APPLICATIONS

This application is a 371 of international application PCT/US2019/023416 filed on Mar. 21, 2019, which claims the benefit of U.S. Provisional Patent Application No. 62/647,406 filed Mar. 23, 2018, which is herein incorporated by reference in its entirety.

STATEMENT REGARDING FEDERALLY SPONSORED RESEARCH OR DEVELOPMENT

Not applicable.

TECHNICAL FIELD

The present disclosure relates generally to positive displacement pump systems. More particularly, the present disclosure relates to a controller configured to operate a reciprocating pump and methods for controlling reciprocation.

BACKGROUND

Positive displacement pumps comprise systems in which a fixed volume of material is drawn into an expanding chamber and pushed out of the chamber as it contracts. Such pumps typically comprise a reciprocating pumping mechanism, such as a piston, or a rotary pumping mechanism, such as a gear set. Reciprocating piston pumps require a bi-directional input that can drive the piston to expand and collapse the pumping chamber (i.e., an upstroke and a downstroke). Typical pumping systems are driven by a rotary input, such as a motor with a rotating output shaft. Rotary input requires unidirectional rotation of the output shaft to be converted into a reciprocating motion. The motors are conventionally configured as air motors powered by compressed air or electric motors powered by alternating current. This is conventionally achieved by the use of crankshaft or cam systems, such as is described in co-owned U.S. Pat. No. 5,145,339 to Lehrke et al. which is herein incorporated by reference in its entirety.

U.S. Pat. No. 2,640,425 to Saalfrank is directed to adjusting pumping during the operation of the pump by moving a pivot which is fixed except for its linear motion and rotation, and therefore can be moved very simply. The pump always completes its stroke at approximately the same point for any adjustment, so that very little error is introduced in pumping compressible liquids even at high pressures. The pump is very effective scavenging the cylinder regardless of the adjustment position.

U.S. Pat. No. 3,459,056 to Lea discloses a mechanism for converting constant reciprocal motion to or from constant torque rotary motion. This mechanism is typically made up of two separate but identical mechanical linkage units which work in parallel but 90°out of phase from one another in connection with a common rotary shaft. Each unit comprises two serially coupled transmission means. Each transmission means is designed to transmit a force F with a resultant force F sin Θ. This mechanism results in equal constant forces being applied reciprocally to the serially coupled transmission means resulting in a constant torque on the rotary shaft, and vice versa.

U.S. Pat. No. 4,089,235 to McWhorter discloses a connecting rod for use in reciprocating piston driven internal or external combustion engines. The connecting rod design presented consists of two component parts pivotally joined near the center and in this respect differs from the single piece rigid link connecting rods generally described as comprising the four-bar linkage slider mechanism of other engine systems.

U.S. Pat. No. 4,384,576 to Farmer discloses a portable positive displacement respirator/ventilator for both a pressure sigh and a volume sigh of predetermined duration and frequency by providing a variable length crank arm connecting a piston through a connecting rod by mounting the connecting rod on a circular toothed gear, pivoting the gear for movement at its center and driven on its outer edge with a separate motor driven pivot gear which when moved relocates the effective length of movement of the point of attachment of the connecting rod thereby changing the volume swept by the piston for the same arc of reciprocal movement of the larger circular toothed gear enabling both a volume change or a volume sigh with the device. A cooperating multiplicity of adjustable pressure regulating valves where at least one can be intermittently closed during the operation of the device regulates ventilation pressure or breathing pressure and sigh pressure.

U.S. Pat. No. 5,145,339 to Lehrke et al. discloses a multiple piston cylinder reciprocating pump with a cam drive such that the sum of the velocities during the pumping strokes of all of the cylinders is generally constant. The leak free design is provided by utilizing a diaphragm attached to the piston between the main seal assembly and the cam. A flow through intake design is provided which flows incoming material around the piston between the diaphragm and the main seal to prevent the build-up and hardening of material on the piston and in the seal area. The intake and exhaust passages are arranged such that air pockets cannot be formed and any air bubbles which find their way into the pump will rise upwardly out of the pump without restriction.

U.S. Pat. No. 5,245,962 to Routery discloses an improved apparatus in an internal combustion engine for causing a piston to remain generally at the top dead center position for a period after the crank has passed top dead center, permitting constant volume combustion of a fuel mixture. A rotatable disc mounted in the upper sleeve end of a connecting rod as an eccentric bore for receiving the wrist pin of a piston. Another eccentric bore in the disc pivotally receives an upper end of a rigid shifter bar. An intermediate portion of the shifter bar is slidably attached to a pin mounted to a lower portion of the piston and a lower portion of the shifter bar is slidably attached to a pin mounted to an intermediate portion of the connecting rod. Thus, angular movement of the connecting rod relative to the pin will cause the shifter bar to rotate the disc imparting an upward motion to the piston to counteract for a time the downward motion of the connecting rod. The position of at least one of the pins may be remotely controlled to be repositioned in proportion to engine speed, or to accommodate alternative fuels.

U.S. Pat. No. 5,988,994 to Berchowitz discloses a pump or compressor wherein the volumetric displacement of a piston cylinder assembly is variable. The piston is connected to a crank slider or eccentric mechanical drive, the crankshaft of which oscillates alternately clockwise through a controllably variable angle Θ and counterclockwise through substantially the same angle Θ, the angle Θ being measured from the angular position of the crankshaft or eccentric at which separation between piston and the closed end of the bore is a minimum (Top Dead Center). The angle of crank oscillation controls the degree of volumetric displacement of the piston. The crank shaft is connected to a torsional spring so as to substantially resonate the rotational inertia of the moving parts. An oscillating electric motor supplies the oscillating torque to drive the mechanism at constant frequency but controllably variable angular amplitude.

U.S. Pat. No. 6,202,622 to Raquiza, Jr., discloses a crank system-device specifically for piston-type internal combustion engines, to maximize the transfer of combustion power from the push-down pressure of the piston to the twisting force of the crankshaft. The device provides for a "Downward Power Path" that enables the piston to push the crank pin downwards and close to the piston centerline, unlike in the case of the "Sideways Power Path" of the prior art wherein the piston pushes the crank pin sideways and away from the piston centerline. To effect a downward power path, an "Off-Center Crankshaft" is resorted to, whereby the crankshaft is moved from its usual position along the piston centerline to the left side thereof, and with an offset distance that places the downward path of the crank pin directly under the piston's downward axis along the piston centerline. A special "Variable-length Connecting Rod", operating in conjunction with a "Multiple Crank Pin" is also provided to suspend the TDC position of the piston and to synchronize it with the new starting point for both the power stroke and the downward power path.

U.S. Pat. No. 6,336,389 to English et al. discloses a pressurized working environment for a pneumatic device which permits emission-free utilization of the potential mechanical energy of pressure differentials within compressed gas systems is disclosed. The pneumatic device is contained within a pressure vessel and the pneumatic device exhaust is in fluid communication with the interior of the pressure vessel. In use, the interior of the pressure vessel is in fluid communication with an area of lower pressure in the compressed gas system and the pneumatic device intake is in fluid communication with an area of higher pressure in the compressed gas system. In use, the gas from the area of higher pressure drives the pneumatic device and is then exhausted to the area of lower pressure.

U.S. Pat. No. 7,028,647 to Styron discloses a variable compression ratio connecting rod for an internal combustion engine, the rod having a large end adapted for attachment to a crankshaft and a small end adapted for attachment to a piston. An adjustable four-bar link system extends between and links the large end and the small end so as to permit the length of the connecting rod to be adjusted through the action of an adjustable toggle link and an eccentric which is driven by inertia forces acting upon the connecting rod.

U.S. Pat. No. 8,713,934 to Berchowitz discloses a free-piston Stirling machine drivingly coupled to at least one rotary electromagnetic transducer. At least one pulley is oriented in a plane of a reciprocating piston connecting rod. At least one motion translating drive link connects the connecting rod to the pulley by at least two straps so that the pulley moves in rotationally oscillating motion. The two straps extend along an arcuate surface of the pulley into connection to the piston rod at two spaced locations. The pulley is linked to a rotary electromagnetic transducer so that both move in rotationally oscillating motion. Preferably a piston spring resonates the piston at an operating frequency of the Stirling machine and a torsion spring resonates the pulley in rotational oscillation at the operating frequency of the Stirling machine.

U.S. Pat. No. 9,765,689 to Amplatz discloses an internal combustion engine having a standard connect-ing rod as well as a gear rack. The connecting rod can be a standard connecting rod that reciprocates with the piston and that drives a rotatable crank mechanism to convert the reciprocating motion of the piston into rotation of the crankshaft. The gear rack is also connected to and recipro-cates with the piston. The gear rack is engaged with a gear that is mounted on the crankshaft. A one-way drive mechanism is provided between the gear and the crankshaft that transmits torque (i.e., rotary force) to the crankshaft only during the power stroke of the piston.

U.S. Pat. App. Pub. No. 2008/0199333 to Detering discloses a compressor unit having a motor and a reciprocating-piston compressor which is driven via a slider-crank drive. The slider-crank drive includes a crank wheel and a connecting rod, which is connected to the crank wheel and a piston. The piston stroke can be adjusted by a threaded connection that allows an exact spacing between the crank drive and the piston to be set.

A pump may be configured for optimal performance with a compressible material (e.g., fire proofing material, etc.). In some pump configurations, such as pump systems with two piston pumps and four ball valves, it has been found that an appreciable percentage of work of the first stroke (e.g., downstroke) after the compressible material has entered the piston cylinder is directed at compressing the compressible material, after which the majority of the percentage of work done by the next stroke (e.g., upstroke) is directed at pumping the compressible material. With double pump systems, the work load may be divided between the pumps, wherein one pump is compressing while the other pump is pumping (moving) the compressible material. However, a problem arises when non-compressible materials (e.g., water) are pumped through pumps configured to pump compressible materials, such as during a pump wash sequence. Because neither pump is compressing material, the pressure within each pump may peak at the same time as the other pump, resulting in significant torque on the rotational drive shaft. The rotational drive shaft and/or corresponding motor input may not be configured to drive such torque demand. As such, there exists a need in the art for a pump that can operate in a range of operation that overcomes high pump pressure demands. There also exists a need for a pump that optimizes high flow demands.

SUMMARY

A non-limiting exemplary embodiment of a pumping system includes a piston disposed within a piston cylinder, a drive shaft, an eccentric coupled to the drive shaft, a connecting arm having opposing first and second ends, and a controller for operating the pumping system. The first end of the connecting arm and the piston are coupled to each other, and the second end of the connecting arm and the eccentric are connected to each other. The controller is configured for controlling the rotation of the drive shaft such that the eccentric oscillates the piston within one of a first high pressure region, a second high pressure region, a first high flow region, and a second high flow region.

Another non-limiting exemplary embodiment of a pumping system includes a piston disposed within a piston cylinder, a drive shaft, an eccentric coupled to the drive shaft, a connecting arm having opposing first and second ends, and a controller for operating the pumping system. The first end of the connecting arm and the piston are coupled to each other, and the second end of the connecting arm and the eccentric are connected to each other. The controller is configured for controlling the rotation of the drive shaft such that the eccentric oscillates the piston within one of a region of maximum relative mechanical advantage and a region of minimum relative mechanical advantage.

A non-limiting exemplary embodiment of a method of operating a pumping system in a region of high pressure is disclosed. In some embodiments, the pumping system includes a piston disposed within a piston cylinder, a drive shaft, an eccentric coupled to the drive shaft, and a connecting arm having opposing first and second ends. The first end of the connecting arm and the piston are coupled to each other, and the second end of the connecting arm and the eccentric are connected to each other. The method includes the steps of oscillating a rotation of the drive shaft in opposing directions by rotating the drive shaft in a first direction whereby a torque and a rotational speed of the drive shaft increase, limiting the rotational speed of the drive shaft to a pre-set minimum speed as the torque approaches a pre-set upper limit, rotating the drive shaft in a second direction opposite the first direction, and limiting the rotational speed of the drive shaft to the pre-set minimum speed as the torque approaches the pre-set upper limit.

A non-limiting exemplary embodiment of a method of operating a pumping system in a region of high flow is disclosed. In some embodiments, the pumping system includes a piston disposed within a piston cylinder, a drive shaft, an eccentric coupled to the drive shaft, and a connecting arm having opposing first and second ends. The first end of the connecting arm and the piston are coupled to each other, and the second end of the connecting arm and the eccentric are connected to each other. The method includes the steps of oscillating a rotation of the drive shaft in opposing directions by rotating the drive shaft in a first direction whereby a torque and a rotational speed of the drive shaft increase, limiting the rotational speed of the drive shaft to a pre-set maximum speed as the torque approaches a pre-set lower limit, rotating the drive shaft in a second direction opposite the first direction, and limiting the rotational speed of the drive shaft to the pre-set maximum speed as the torque approaches the pre-set lower limit.

DETAILED DESCRIPTION

One or more non-limiting embodiments are described herein with reference to the accompanying drawings, wherein like numerals designate like elements. It should be clearly understood that there is no intent, implied or otherwise, to limit the disclosure in any way, shape or form to the embodiments illustrated and described herein. While multiple exemplary embodiments are provided, variations thereof will become apparent or obvious to a person of ordinary skills. Accordingly, any and all variants for providing functionalities similar to those described herein are considered as being within the metes and bounds of the instant disclosure.

Figure 1:
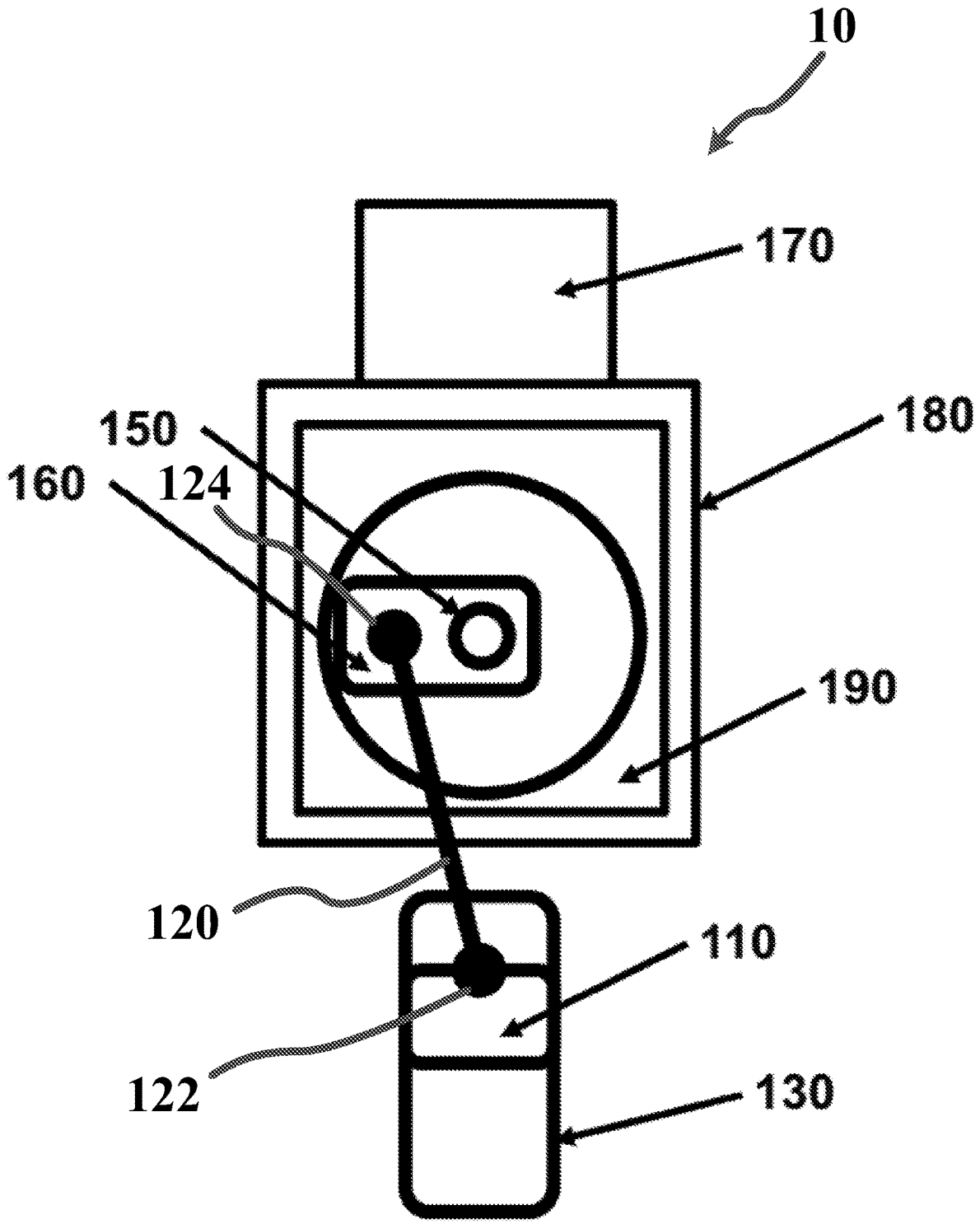
FIG. 1 is a cross-sectional view of a non-limiting exemplary embodiment of a pumping system of the instant disclosure.

FIG. 1 is a cross-sectional view of a non-limiting exemplary embodiment of a pumping system (or pump) 10 of the instant disclosure. In certain embodiments, the pumping system 10 includes a piston 110 disposed within a piston cylinder 130, a drive shaft 150 driven by a motor 180, and a controller 170. The motor 180 can be, but is not limited to, an air motor powered by compressed air or an electric motor powered by alternating current. In some embodiments, the controller 170 controls the output (e.g., rotational direction, rotational speed, etc.) of the drive shaft 150 by controlling the direction and/or speed of the motor 180. In certain embodiments, the controller 170 accepts AC or DC voltage as an input power source and outputs AC or DC voltage to control the motor 180. In some embodiments, the controller 170 is configured to measure the motor current, and measure or estimate the motor position and speed using components and/or methods well known in the art including, but not limited to, sensor-less control algorithms, encoders, feedback loops, hall sensors, among others.

In a non-limiting exemplary embodiment, the pumping system 10 includes a drive section defined at least in part by the drive shaft 150 and the eccentric 160 (e.g., crank arm, scotch yoke, etc.). Generally, the drive section is configured to drive or operate the piston 110. In some embodiments, a connecting arm 120 connects the pump section and the drive section to each other. In certain embodiments, the connecting arm 120 and the piston 110 are connected at connection point 122. The opposite end of the connecting arm 120 connects to the eccentric 160 at connection point 124.

In a non-limiting exemplary embodiment, the pumping system 10 includes an intermediate drive 190 (e.g., gear drive, transmission, clutch, etc.) as is well known in the art. In some embodiments, the intermediate drive 190 is located between the motor 180 and the drive shaft 150. In certain embodiments, the controller 170 may control the output (e.g., direction, speed, gearing, etc.) of the intermediate drive 190 in order to control the rotation of the drive shaft 150. The motor 180 or intermediate drive 190 may be referred to generically as an actuator, to the extent they drive the drive shaft 150. In some embodiments, control of the intermediate drive 190 by the controller 170 may be in addition to the control of the motor 180. Alternatively, the controller 170 may only control the output of the drive shaft 150 via control of the intermediate drive 190. In certain embodiments, the controller 170 is configured to ascertain the position of the drive shaft 150 from various methods known in the art including, but not limited to, sensor-less control algorithms, clocking signals from an external position sensor, etc.

Figure 2A:
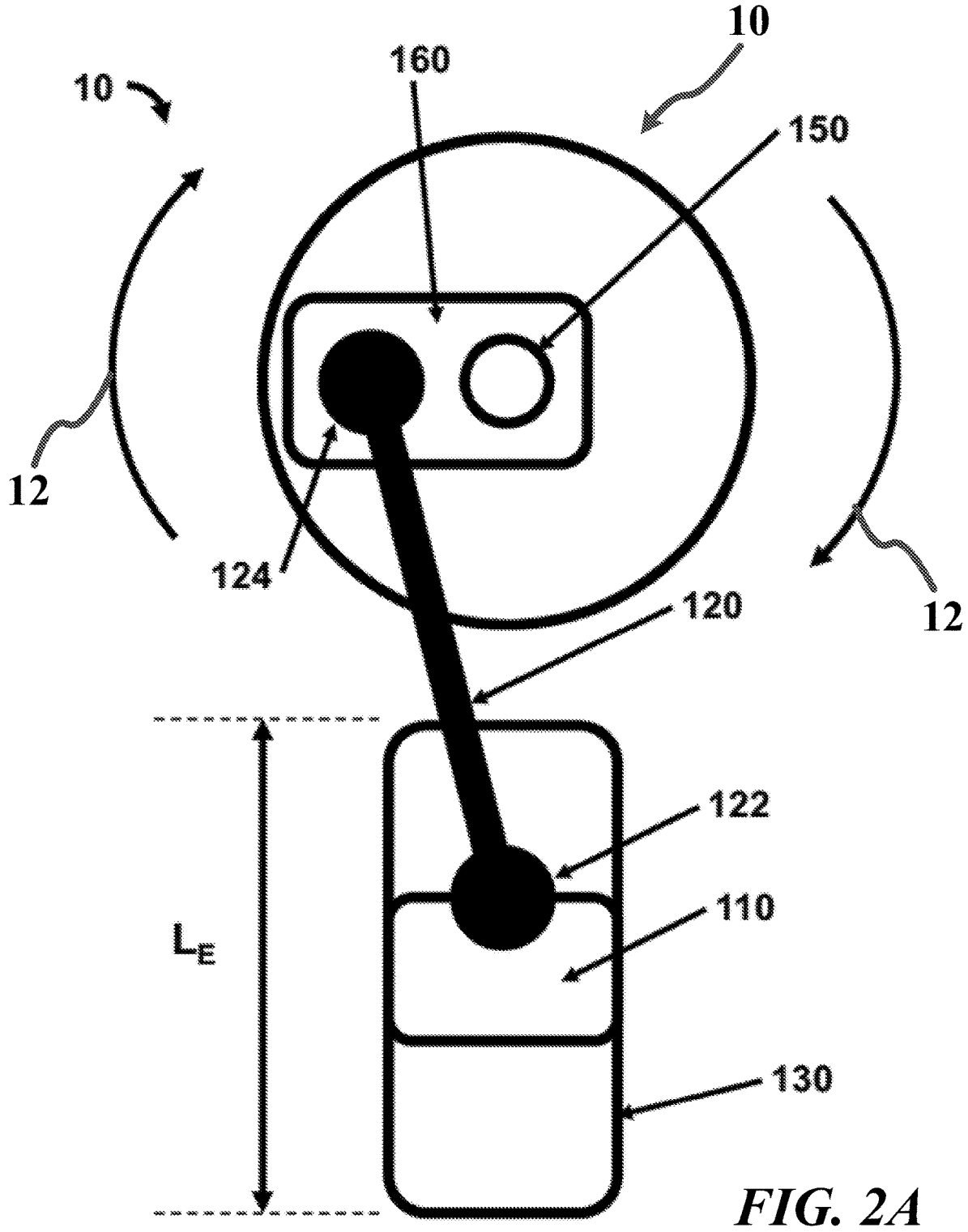
FIG. 2A illustrates the operation of the pump of FIG. 1.
Figure 2B:
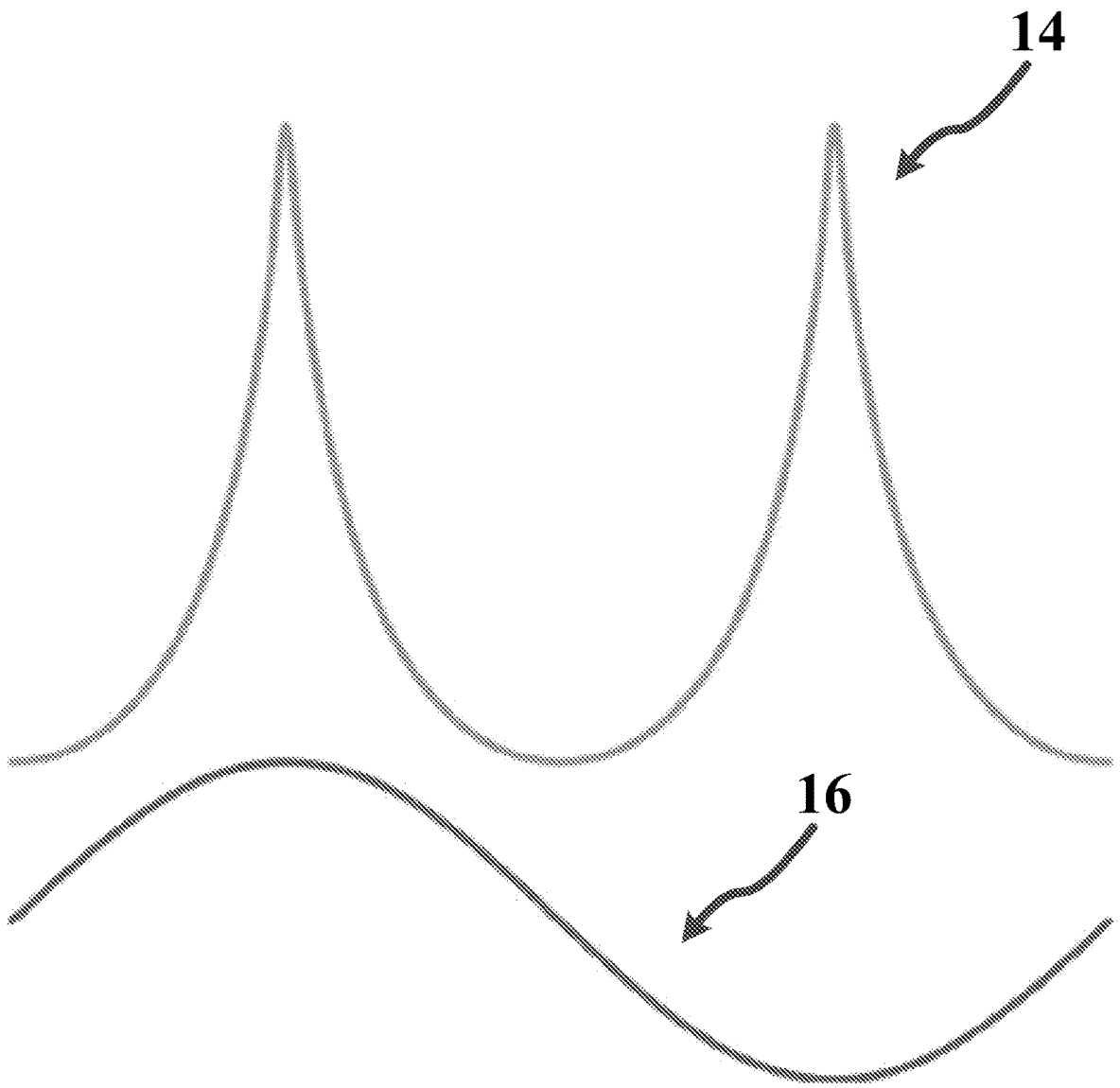
FIG. 2B illustrates the linear position of the piston and the corresponding relative mechanical advantage of the pump of FIG. 2A during one rotation of the drive shaft.

FIG. 2A illustrates the operation of the pumping system 10. The motor (not shown) rotates the drive shaft 150 continuously in the same direction, for example as indicated by the arrows 12. One complete revolution of the drive shaft 150 results in one upstroke and one downstroke of the piston 110, and the revolutions are repeated to continue operation of the pumping system 10. Each stroke of the piston 110 performs work either pumping material out of the cylinder 130 or filling the cylinder 130 with material. FIG. 2B illustrates the linear position 16 of the piston 110 within the piston cylinder 130 and the corresponding relative mechanical advantage 14 of the pumping system 10 during one complete revolution of the drive shaft 150. The distance $L_E$ represents the stroke or the displacement of the piston 110 within the piston cylinder 130 during one complete revolution of the drive shaft 150. Peak or maximum torque and maximum motor current draw occurs when the rate of displacement of the piston 110 with respect to the rate of change of the rotation angle of the eccentric 160 (and the drive shaft 150) is approximately maximum or greatest. Nominally, this occurs at approximately the 3 o'clock and 9 o'clock positions of the eccentric 160 (and the drive shaft 150). The corresponding relative mechanical advantage 14 of the pumping system 10 is approximately minimum at these positions, and the flow rate of the material through the pumping system 10 is substantially consistent. Similarly, minimum torque and minimum current draw occurs when the rate of displacement of the piston 110 with respect to the rate of change of the rotation angle of the eccentric 160 (and the drive shaft 150) is approximately minimum. Nominally, this occurs at approximately the 12 o'clock and 6 o'clock positions of the eccentric 160 (and the drive shaft 150). The corresponding relative mechanical advantage 14 of the pumping system 10 is approximately maximum at these positions.

Figure 3A:
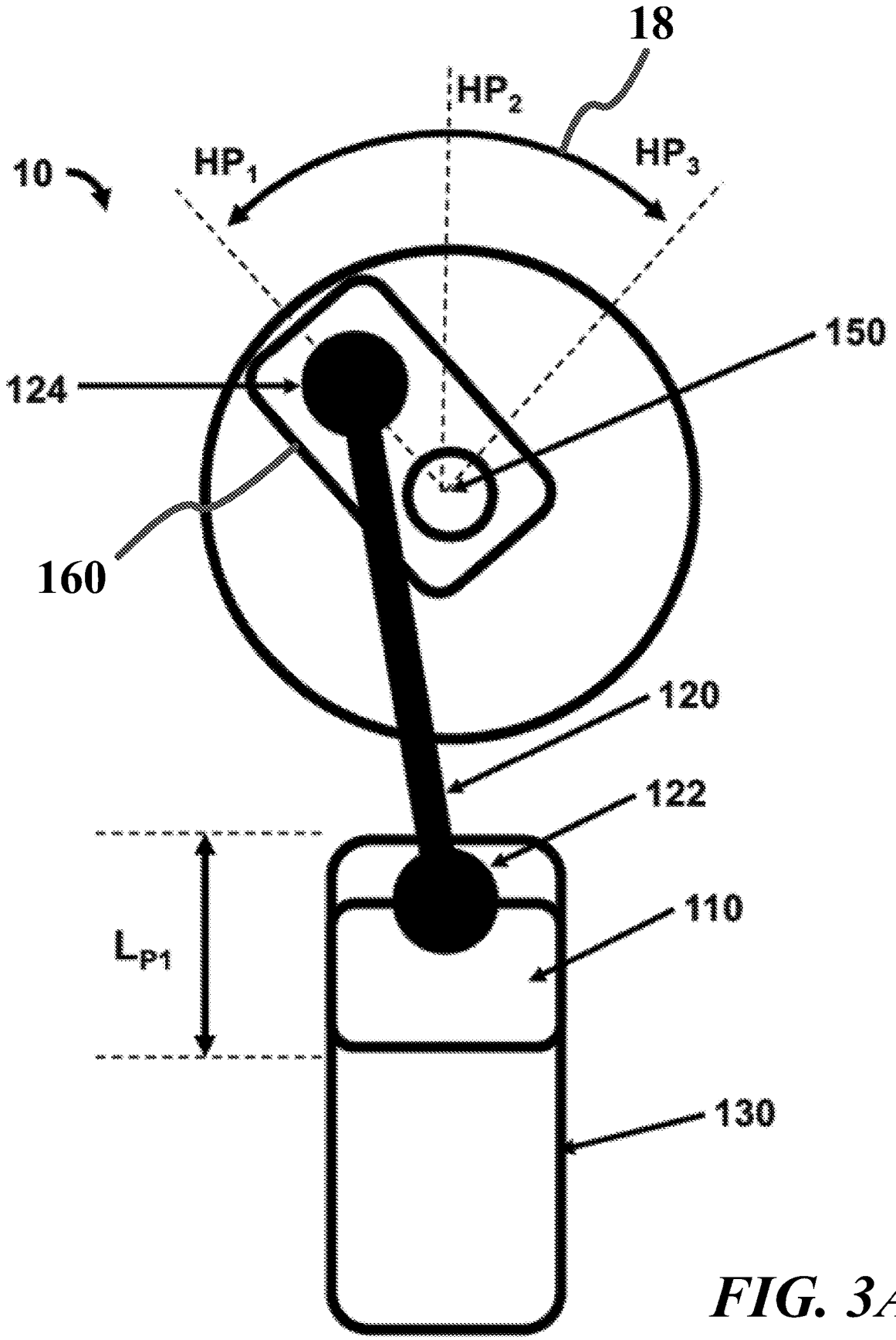
FIG. 3A illustrates an exemplary operation of the pump in a high pressure region.
Figure 3B:
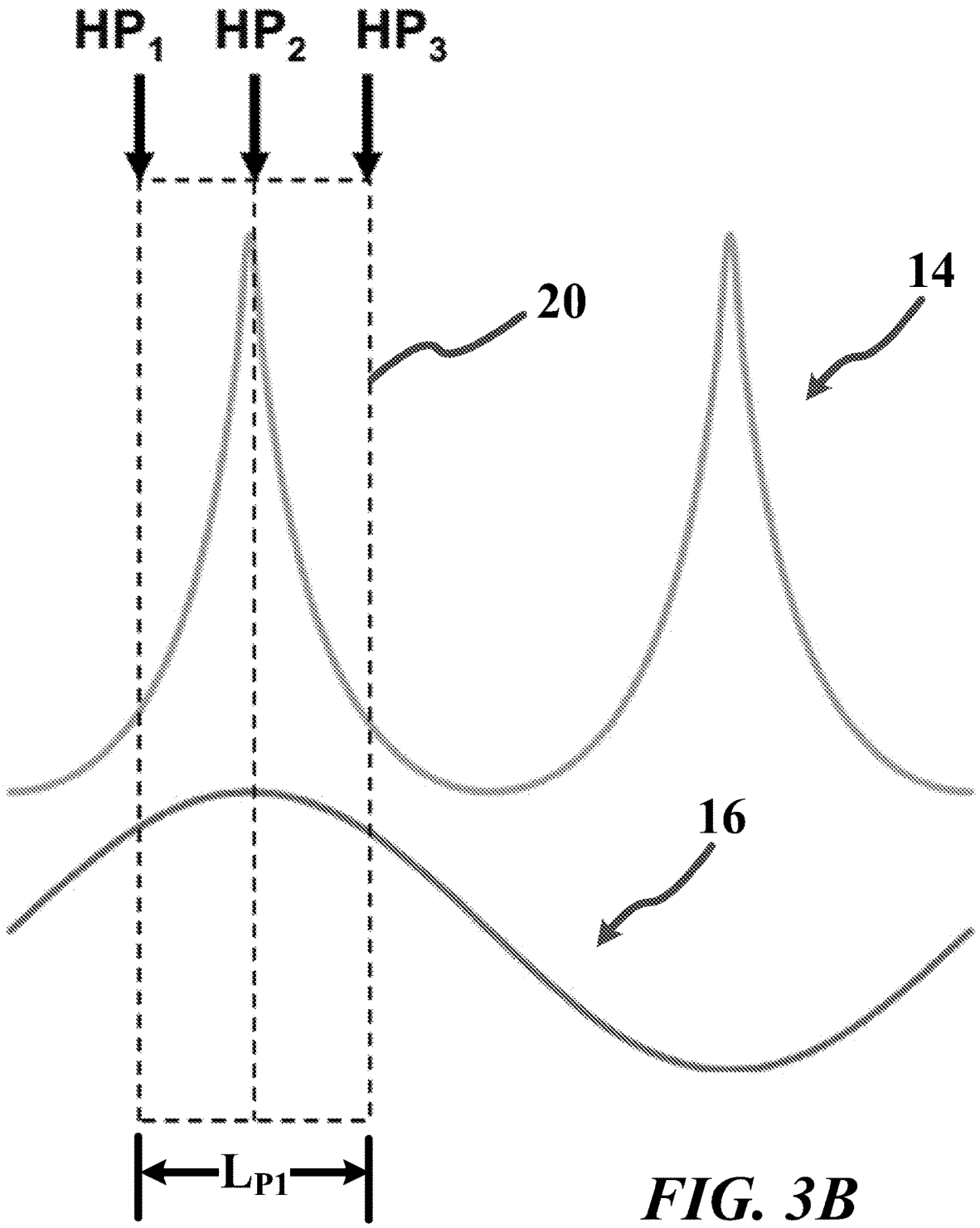
FIG. 3B illustrates exemplary linear positions of the piston and the corresponding relative mechanical advantage for the pump of FIG. 3A.

FIG. 3A is a cross-sectional view of the pumping system 10 illustrating a non-limiting exemplary embodiment of operating the pumping system 10 within a high pressure region between $HP_1$ and $HP_3$. FIG. 3B illustrates non-limiting exemplary linear positions 16 of the piston 110 within the cylinder 130 when the pumping system 10 is operated between $HP_1$ and $HP_3$. In some embodiments, the drive shaft 150 oscillates or rotates back and forth, as shown by the arc arrow 18, between the positions $HP_1$ and $HP_3$. During one displacement or movement of the eccentric 160 and the connecting point 124 between $HP_1$ and $HP_3$, the piston 110 is linearly displaced or travels a distance $L_{P1}$ within the cylinder 130. The dashed box 20 in FIG. 3B illustrates the linear position 16, viz., $L_{P1}$, of the piston 110 and the corresponding relative mechanical advantage 14 when the pumping system 10 is operated in the high pressure region between $HP_1$ and $HP_3$. Minimum torque and minimum current draw occurs when the rate of displacement of the piston 110 is at a minimum with respect to the rate of change of the motor rotor angle which, in this instance, is approximately at the 12 o'clock position of the eccentric 160 and the connecting point 124. As illustrated, the linear position 16 of the piston 110 at $HP_2$ approximately corresponds with the maximum relative mechanical advantage 14 in the high pressure region between $HP_1$ and $HP_3$. It should be noted that the drive shaft 150 does not complete one full rotation. A substantially similar high pressure region exists opposite the high pressure region between $HP_1$ and $HP_3$.

Figure 4A:
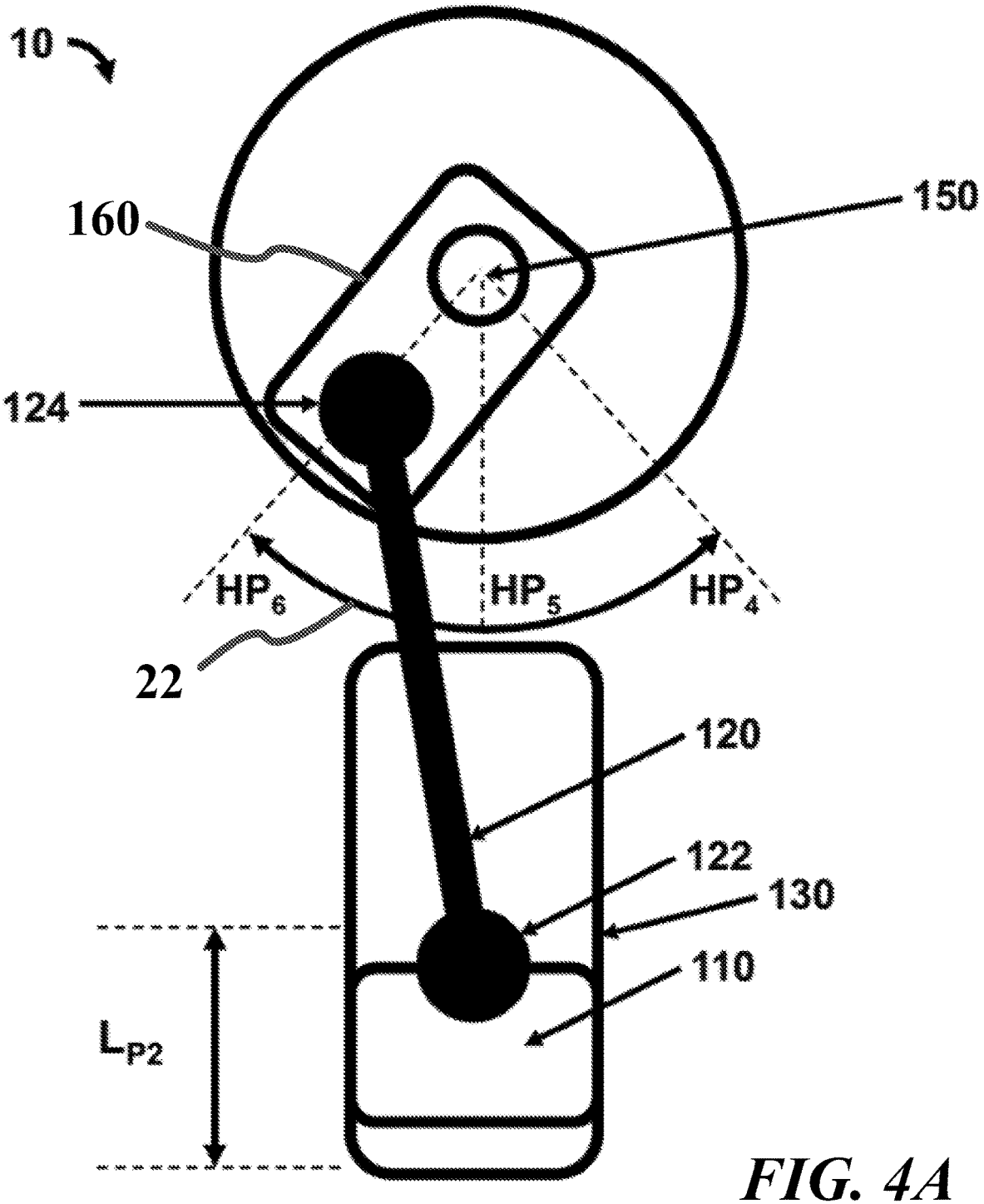
FIG. 4A illustrates an exemplary operation of the pump in another high pressure region.
Figure 4B:
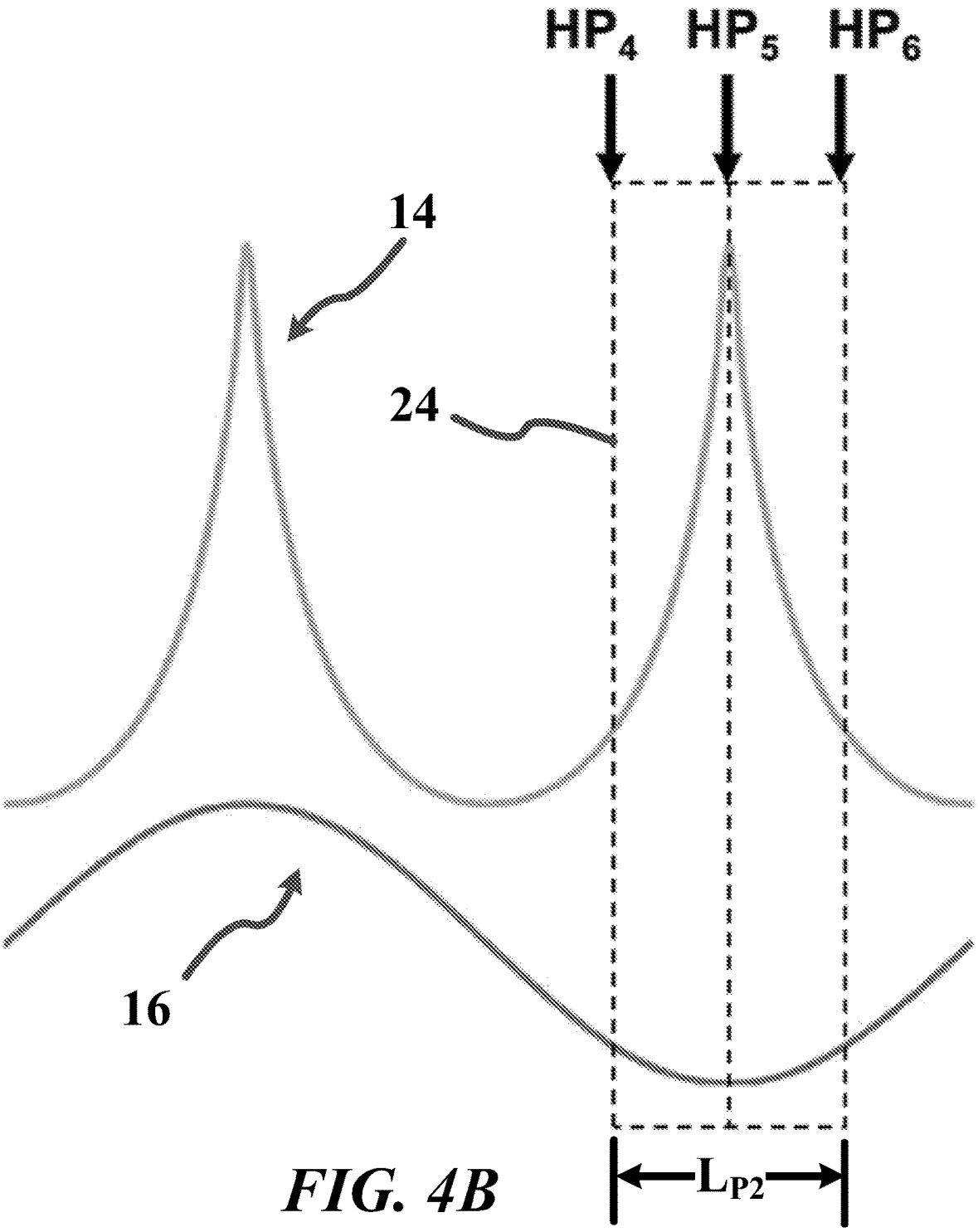
FIG. 4B illustrates exemplary linear positions of the piston and the corresponding relative mechanical advantage for the pump of FIG. 4A.

FIG. 4A is a cross-sectional view of the pumping system 10 illustrating a non-limiting exemplary embodiment of operating the pumping system 10 within another high pressure region between $HP_4$ and $HP_6$ opposite the high pressure region between $HP_1$ and $HP_3$. FIG. 4B illustrates non-limiting exemplary linear positions 16 of the piston 110 within the cylinder 130 when the pumping system 10 is operated between $HP_4$ and $HP_6$. In some embodiments, the drive shaft 150 oscillates or rotates back and forth, as shown by the arc arrow 22, between the positions $HP_4$ and $HP_6$. During one displacement or movement of the eccentric 160 and the connecting point 124 between $HP_4$ and $HP_6$, the piston 110 is linearly displaced or travels a distance $L_{P2}$ within the cylinder 130. The dashed box 24 in FIG. 4B illustrates the linear position 16, viz., $L_{P2}$, of the piston 110 and the corresponding relative mechanical advantage 14 when the pumping system 10 is operated in the high pressure region between $HP_4$ and $HP_6$. Minimum torque and minimum current draw occurs when the rate of displacement of the piston 110 is at a minimum with respect to the rate of change of the motor rotor angle which, in this instance, is approximately at the 6 o'clock position of the eccentric 160 and the connecting point 124. As illustrated, the linear position 16 of the piston 110 at $HP_5$ approximately corresponds with the maximum relative mechanical advantage 14 in the high pressure region between $HP_4$ and $HP_6$. It should be noted that the drive shaft 150 does not complete one full rotation.

Figure 5A:
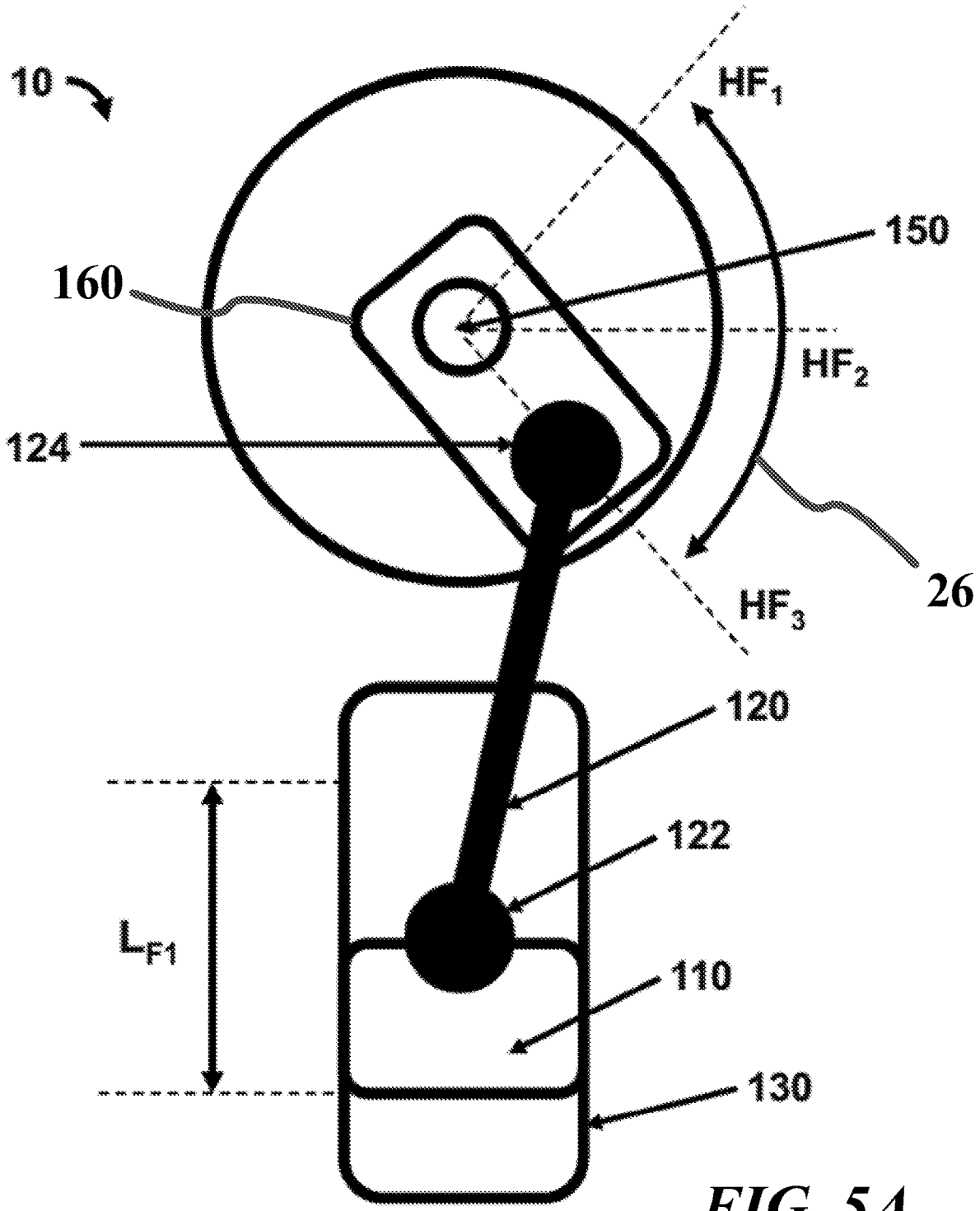
FIG. 5A illustrates an exemplary operation of the pump in a high flow region.
Figure 5B:
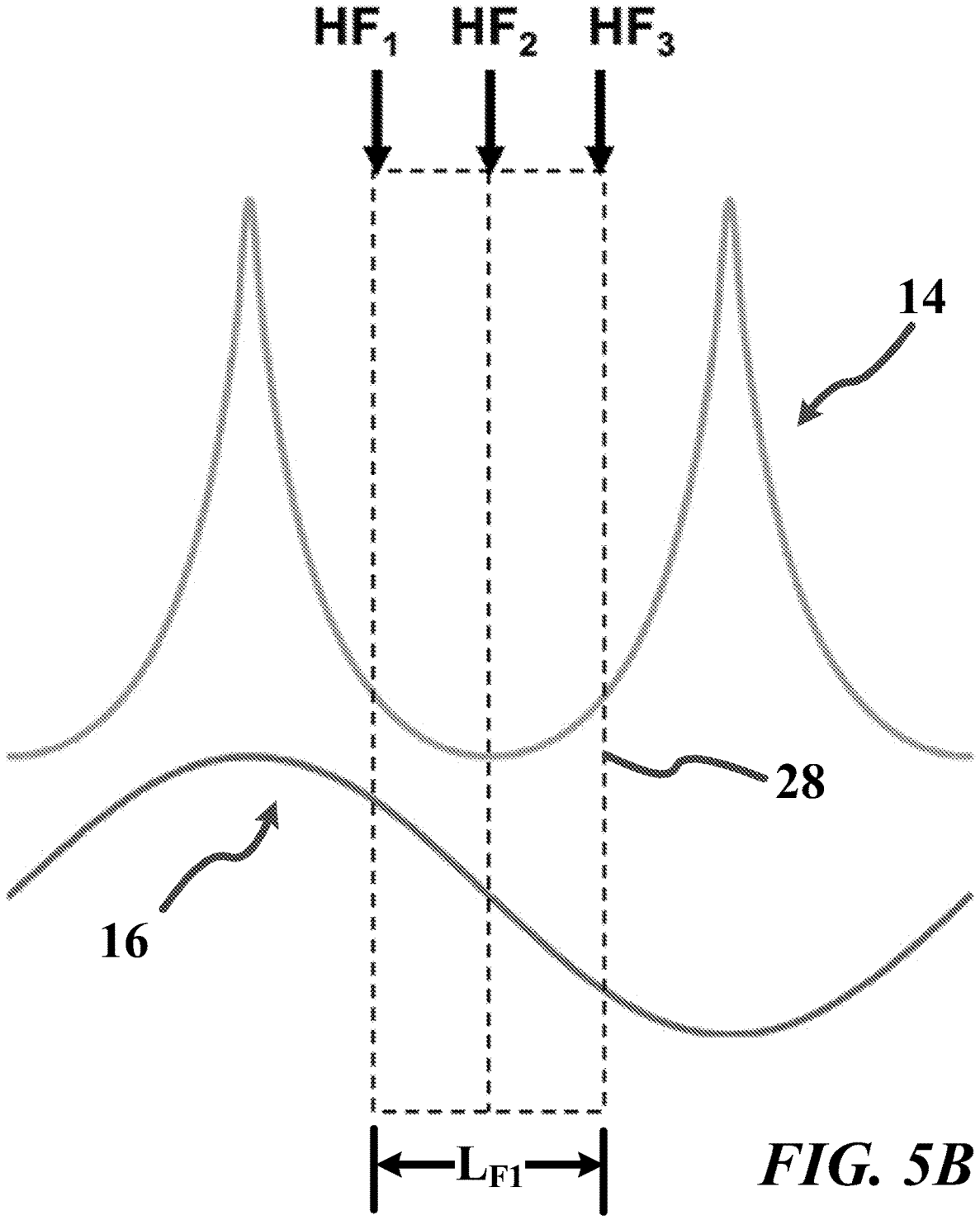
FIG. 5B illustrates exemplary linear positions of the piston and the corresponding relative mechanical advantage for the pump of FIG. 5A.

FIG. 5A is a cross-sectional view of the pumping system 10 illustrating a non-limiting exemplary embodiment of operating the pumping system 10 within a high flow region between $HF_1$ and $HF_3$. FIG. 5B illustrates non-limiting exemplary linear positions 16 of the piston 110 within the cylinder 130 when the pumping system 10 is operated between $HF_1$ and $HF_3$. In some embodiments, the drive shaft 150 oscillates or rotates back and forth, as shown by the arc arrow 26, between the positions $HF_1$ and $HF_3$. During one displacement or movement of the eccentric 160 and the connecting point 124 between $HF_1$ and $HF_3$, the piston 110 is linearly displaced or travels a distance $L_{F1}$ within the cylinder 130. The dashed box 28 in FIG. 5B illustrates the linear position 16, viz., $L_{F1}$, of the piston 110 and the corresponding relative mechanical advantage 14 when the pumping system 10 is operated in the high flow region between $HF_1$ and $HF_3$. Peak or maximum torque and maximum motor current draw occurs when the rate of displacement of the piston 110 is greatest with respect to the rate of change of the motor rotor angle which, in this instance, is at the 3 o'clock position of the eccentric 160 and the connecting point 124. As illustrated, the linear position 16 of the piston 110 at $HF_2$ approximately corresponds with the highest flow displacement per change of angular position in the high flow region between $HF_1$ and $HF_3$. Also as illustrated, the relative mechanical advantage 14 during operation within the high flow region between $HF_1$ and $HF_3$ is a minimum which corresponds to a more consistent flow rate. It should be noted that the drive shaft 150 does not complete one full rotation. A substantially similar high flow region exists opposite the high flow region between $HF_1$ and $HF_3$.

Figure 6A:
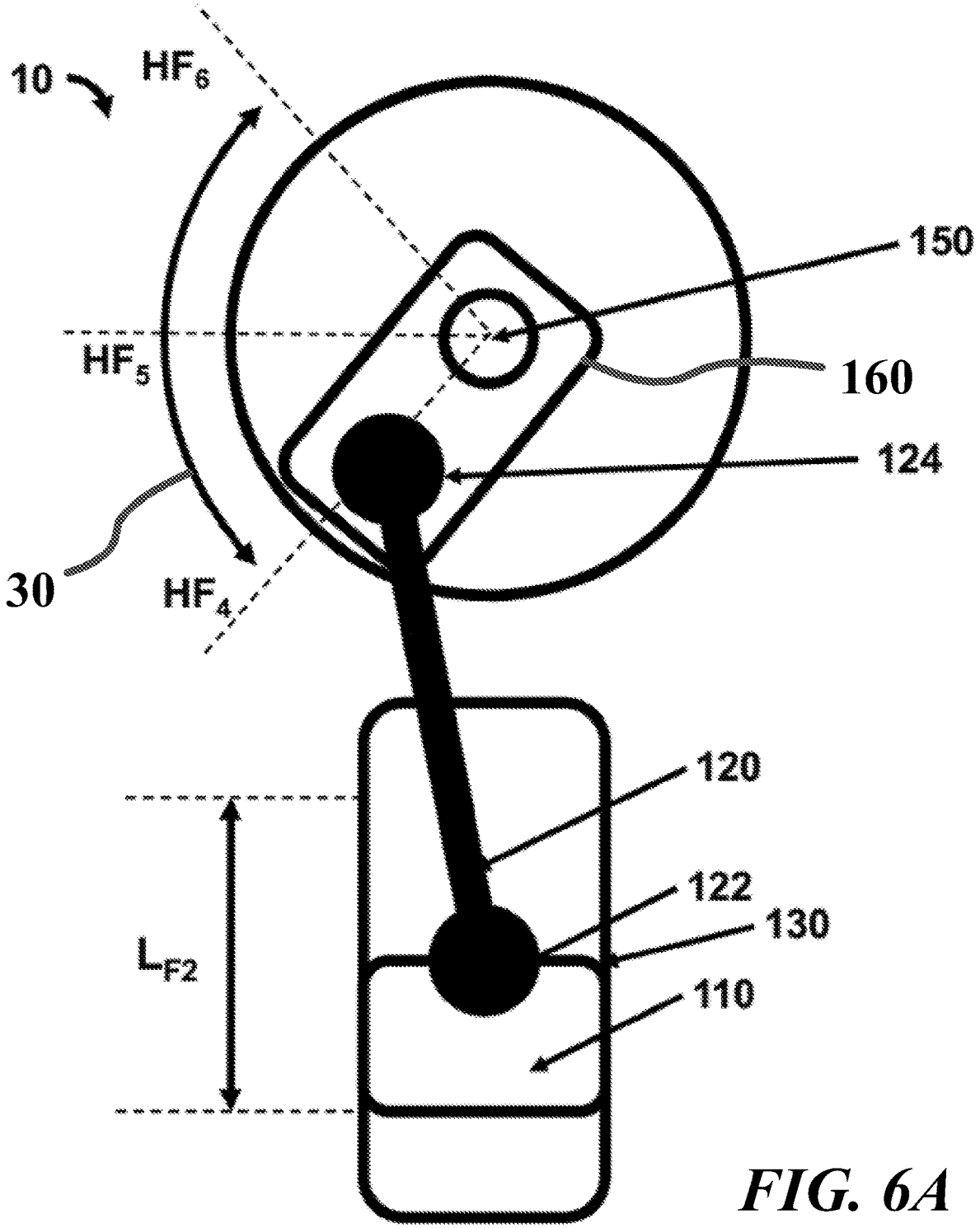
FIG. 6A illustrates an exemplary operation of the pump in another high flow region.
Figure 6B:
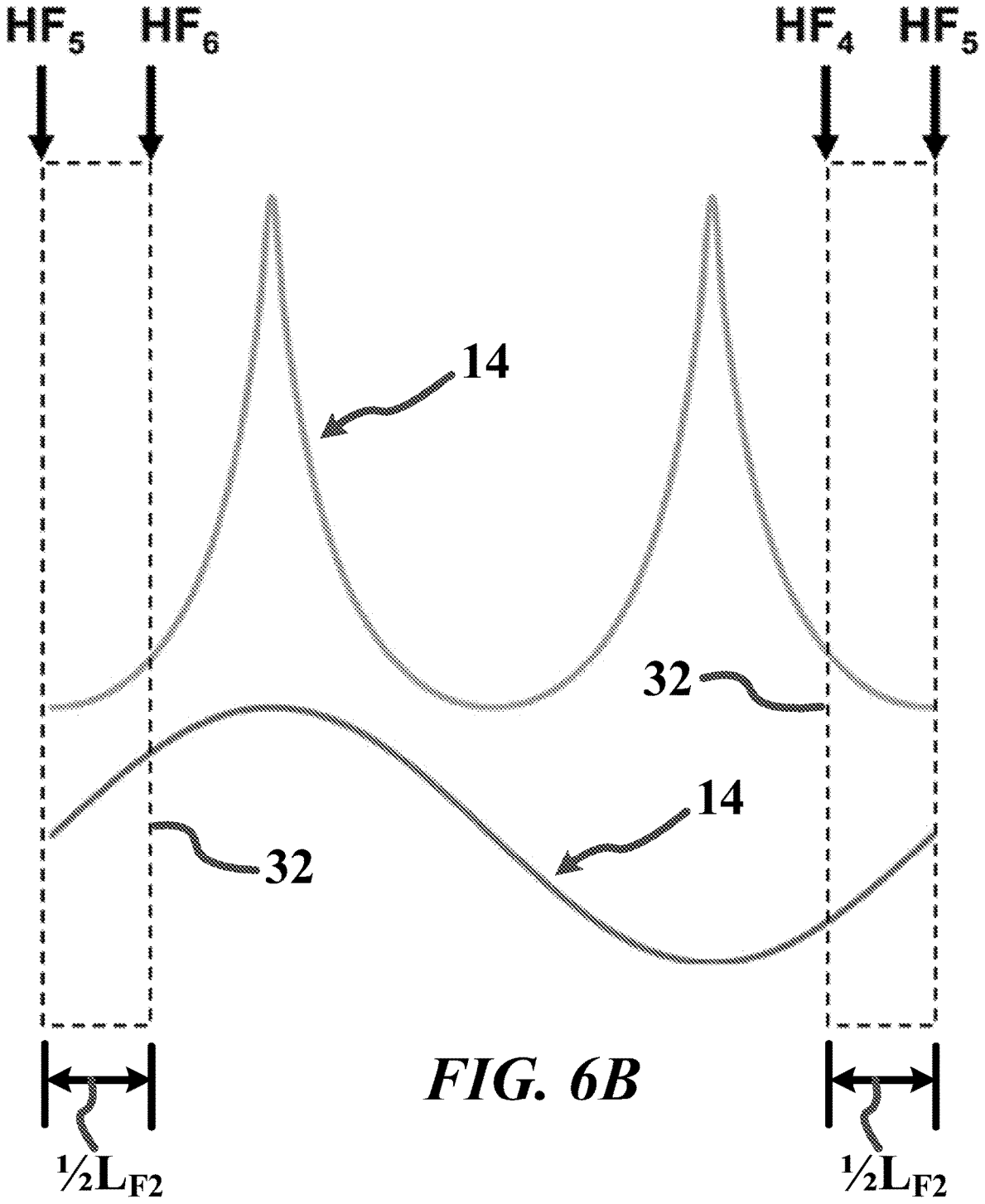
FIG. 6B illustrates exemplary linear positions of the piston and the corresponding relative mechanical advantage for the pump of FIG. 6A.

FIG. 6A is a cross-sectional view of the pumping system 10 illustrating a non-limiting exemplary embodiment of operating the pumping system 10 within a high flow region between $HF_4$ and $HF_6$ opposite the high flow region between $HF_1$ and $HF_3$. FIG. 6B illustrates non-limiting exemplary linear positions 16 of the piston 110 within the cylinder 130 when the pumping system 10 is operated between $HF_4$ and $HF_6$. In some embodiments, the drive shaft 150 oscillates or rotates back and forth, as shown by the arc arrow 30, between the positions $HF_4$ and $HF_6$. During one displacement or movement of the eccentric 160 and the connecting point 124 between $HF_4$ and $HF_6$, the piston 110 is linearly displaced or travels a distance $L_{F2}$ within the cylinder 130. The dashed box 32 in FIG. 6B illustrates the linear position 16 of the piston 110 and the corresponding relative mechanical advantage 14 when the pumping system 10 is operated in the high flow region between $HF_4$ and $HF_6$. Peak or maximum torque and maximum motor current draw occurs when the rate of displacement of the piston 110 is greatest with respect to the rate of change of the motor rotor angle which, in this instance, is at the 9 o'clock position of the eccentric 160 and the connecting point 124. As illustrated, the linear position 16 of the piston 110 at $HF_5$ approximately corresponds with the highest flow displacement per change of angular position in the high flow region between $HF_4$ and $HF_6$. Also as illustrated, the relative mechanical advantage 14 during operation within the high flow region between $HF_4$ and $HF_6$ is a minimum which corresponds to a more consistent flow rate. It should be noted that the drive shaft 150 does not complete one full rotation.

Figure 7:
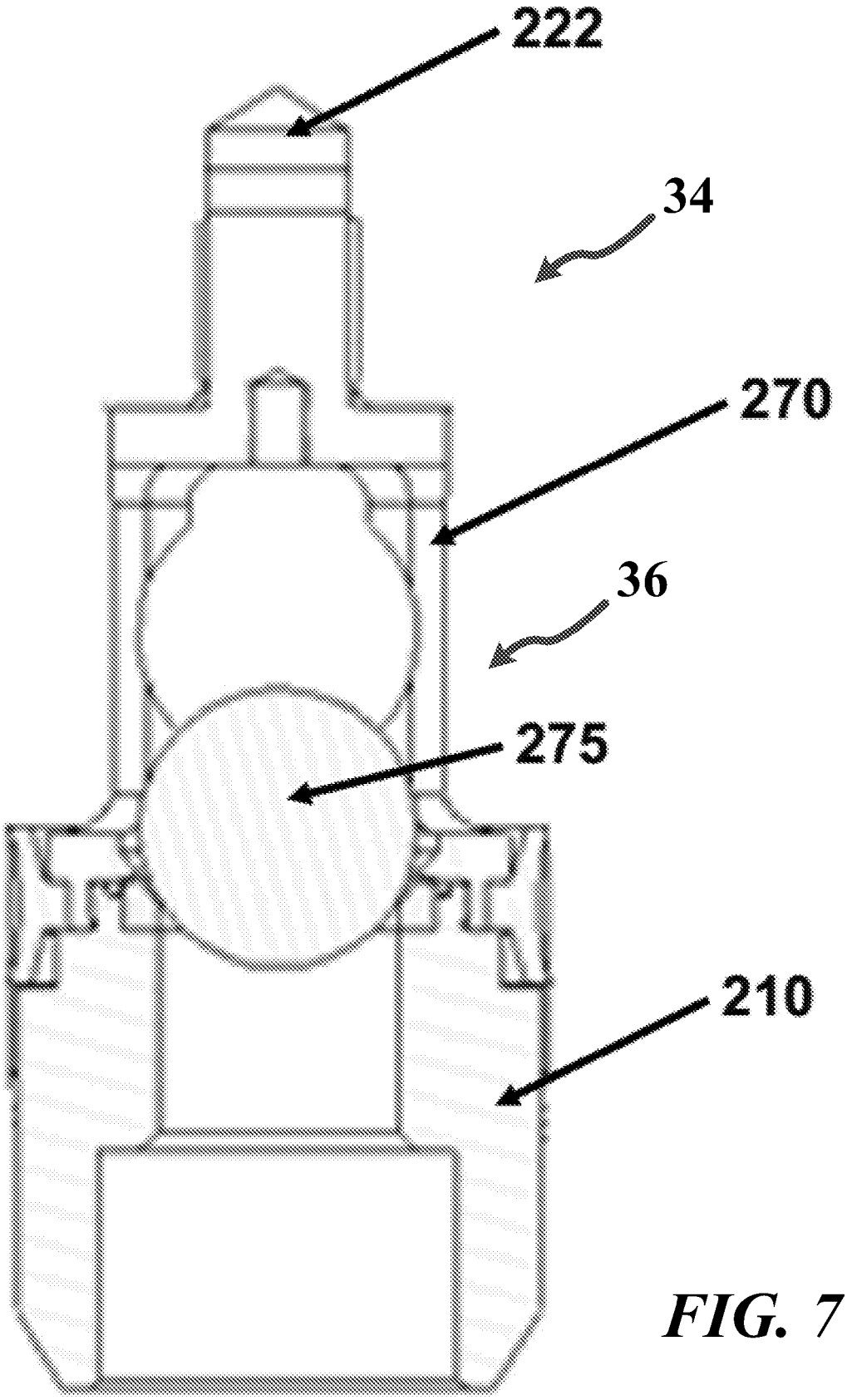
FIG. 7 is a cross-sectional view of a non-limiting exemplary embodiment of a pump having a ball valve.

FIG. 7 is a cross-sectional view of a non-limiting exemplary embodiment of a pump 34 having at least one ball valve 36 and a piston 210 configured for controlling the movement of material throughout the pump 34 and generating pressure. In a non-limiting exemplary embodiment, the ball valve 36 includes a ball 275 and a ball cage 270. In some embodiments, a connecting arm (e.g., connecting arm 120; not shown) and the piston 210 are connected at connection point 222. The opposite end of the connecting arm may be connected to the eccentric 160.

Figure 8:
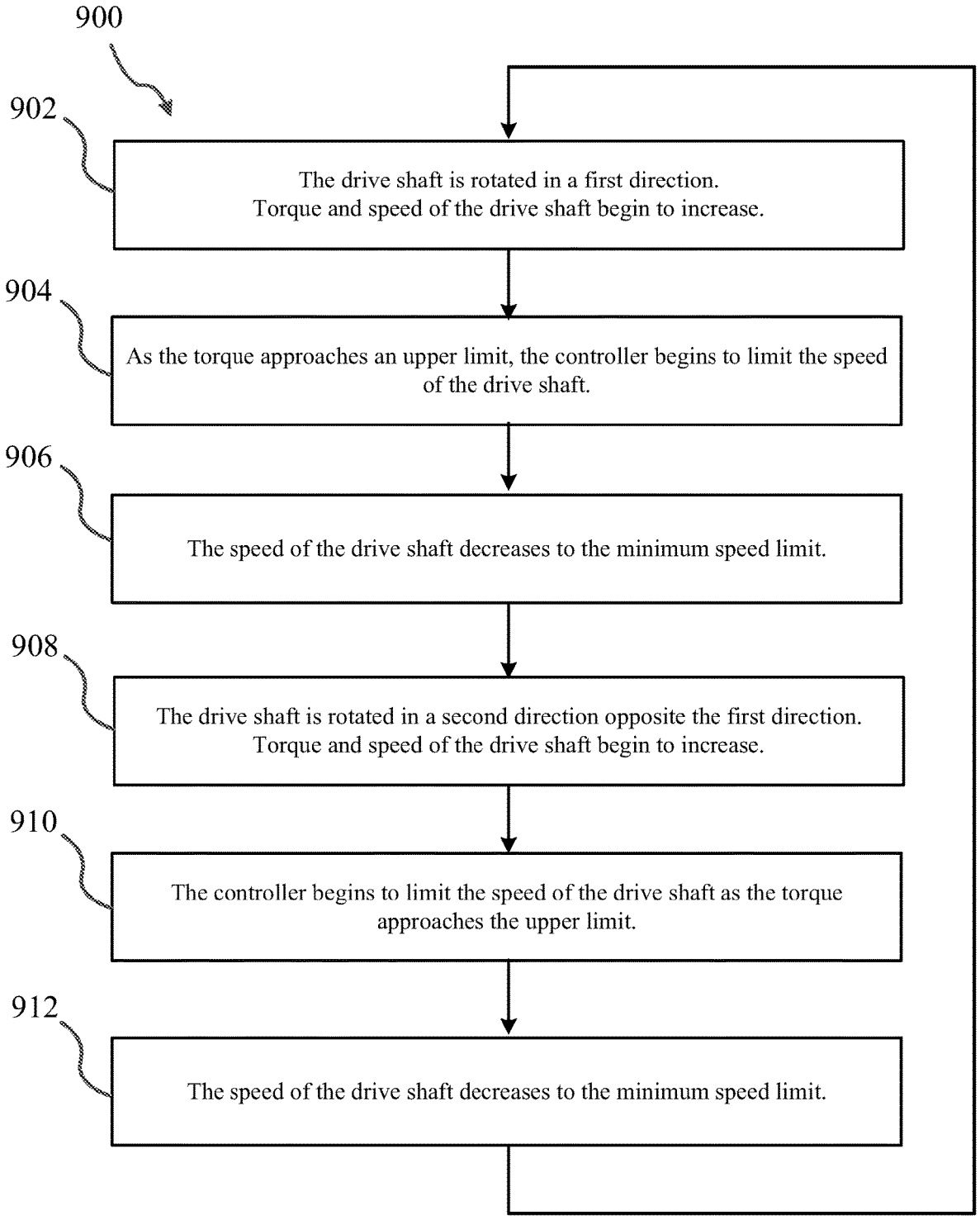
FIG. 8 is a flow chart of a non-limiting exemplary embodiment of a method of operating the pump of the instant disclosure in the high pressure regions illustrated in FIGS. 3 and 4.

FIG. 8 is a flow chart of a non-limiting exemplary embodiment of a method 900 for operating the pumping system 10 of the instant disclosure in the high pressure region between $HP_1$ and $HP_3$ illustrated in FIGS. 3A and 3B or in the high pressure region between $HP_4$ and $HP_6$ illustrated in FIGS. 4A and 4B. In some embodiments, the method 900 operates without a position sensor. The method 900 begins at step 902 whereat the controller 170, via a processor, commands the drive shaft 150 to rotate in direction A. The torque and speed of the drive shaft 150 begin to increase, which is detected by the controller 170 via the processor. At step 904, the controller 170, via the processor, begins to limit the speed of the drive shaft 150 as the torque approaches an upper limit. At step 906, the speed of the drive shaft 150 decreases to the point of reaching a minimum speed limit, which is detected by the controller 170 via the processor. The controller 170, via the processor, commands the drive shaft 150 to stop. At step 908, the controller 170, via the processor, commands the drive shaft 150 to rotate in direction B opposite the direction A. The torque and speed of the drive shaft 150 begin to increase, which is detected by the controller 170 via the processor. At step 910, the controller 170, via the processor, begins to limit the speed of the drive shaft 150 as the torque approaches the upper limit. At step 912, the speed of the drive shaft 150 decreases to the point of reaching a minimum speed limit, which is detected by the controller 170 via the processor. The controller 170, via the processor, commands the drive shaft 150 to stop. The method 900 (or process) repeats starting at step 902.

Figure 9:
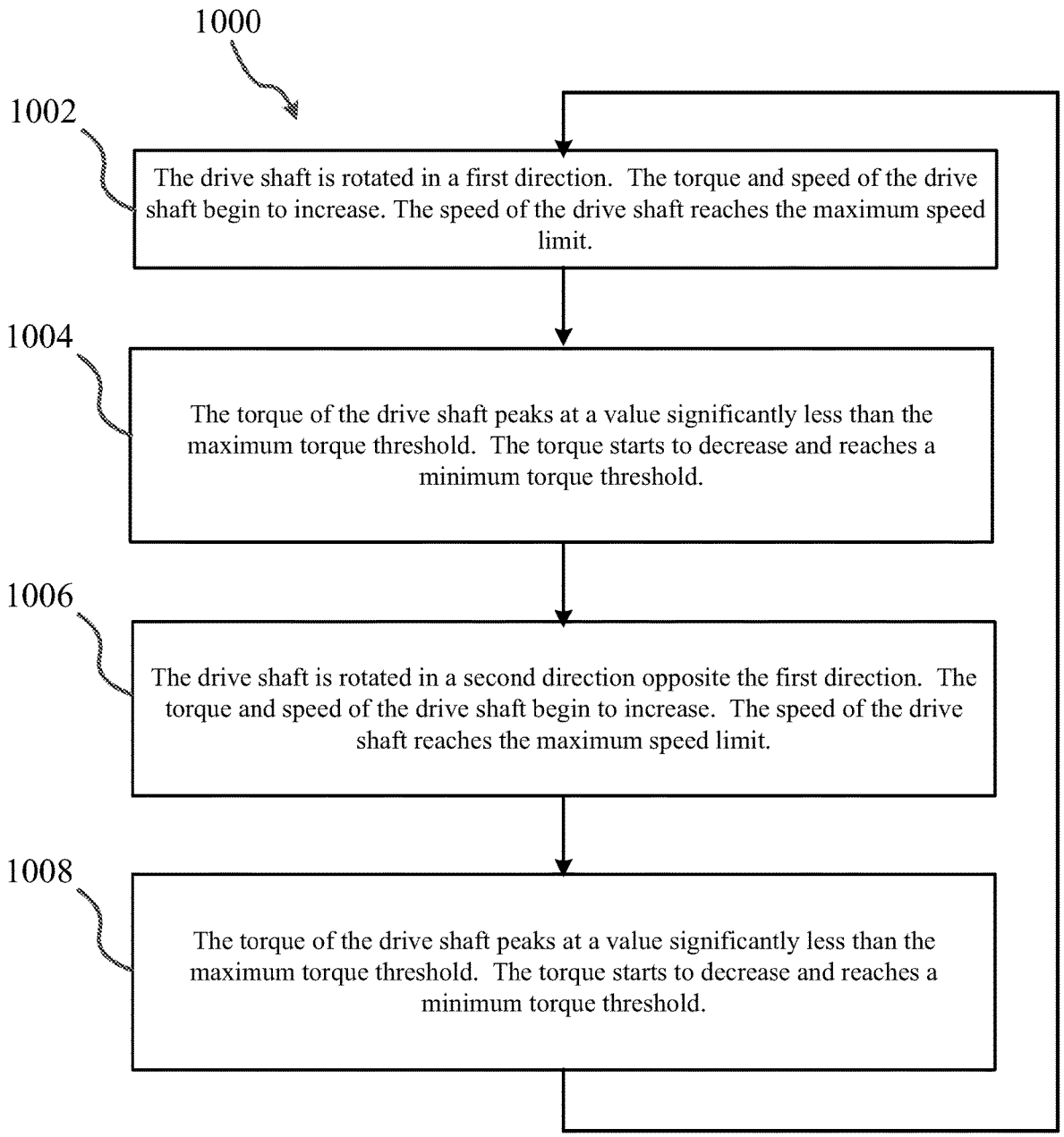
FIG. 9 is a flow chart of a non-limiting exemplary embodiment of a method of operating the pump of the instant disclosure in the high flow regions illustrated in FIGS. 5 and 6.

FIG. 9 is a flow chart of a non-limiting exemplary embodiment of a method 1000 for operating the pumping system 10 of the instant disclosure in the high flow region between $HF_1$ and $HF_3$ illustrated in FIGS. 5A and 5B or in the high flow region between $HF_4$ and $HF_6$ illustrated in FIGS. 6A and 6B. In some embodiments, the method 1000 operates without a position sensor. The method 1000 begins at step 1002 whereat a controller 170, via a processor, commands the drive shaft 150 to rotate in direction A. The torque and speed of the drive shaft 150 begin to increase, and the speed of the drive shaft 150 reaches the maximum speed limit. At step 1004, the torque of the drive shaft 150 peaks at a value which is significantly below the maximum torque threshold, which is detected by the controller 170 via the processor. The torque value starts to decrease and eventually reaches a minimum torque threshold, which is detected by the controller 170 via the processor. The controller 170, via the processor, commands the drive shaft 150 to stop. At step 1006, the controller 170, via the processor, commands the drive shaft 150 to rotate in direction B opposite the direction A. The torque and speed of the drive shaft 150 begin to increase, which is detected by the controller 170 via the processor. The speed of the drive shaft 150 reaches the maximum speed limit, which is detected by the controller 170 via the processor. At step 1008, the torque of the drive shaft 150 peaks at a value which is significantly below the maximum torque threshold, which is detected by the controller 170 via the processor. The torque value starts to decrease and eventually reaches a minimum torque threshold, which is detected by the controller 170 via the processor. The controller 170, via the processor, commands the drive shaft 150 to stop. The method 1000 (or process) repeats starting at step 1002.

Figure 10:
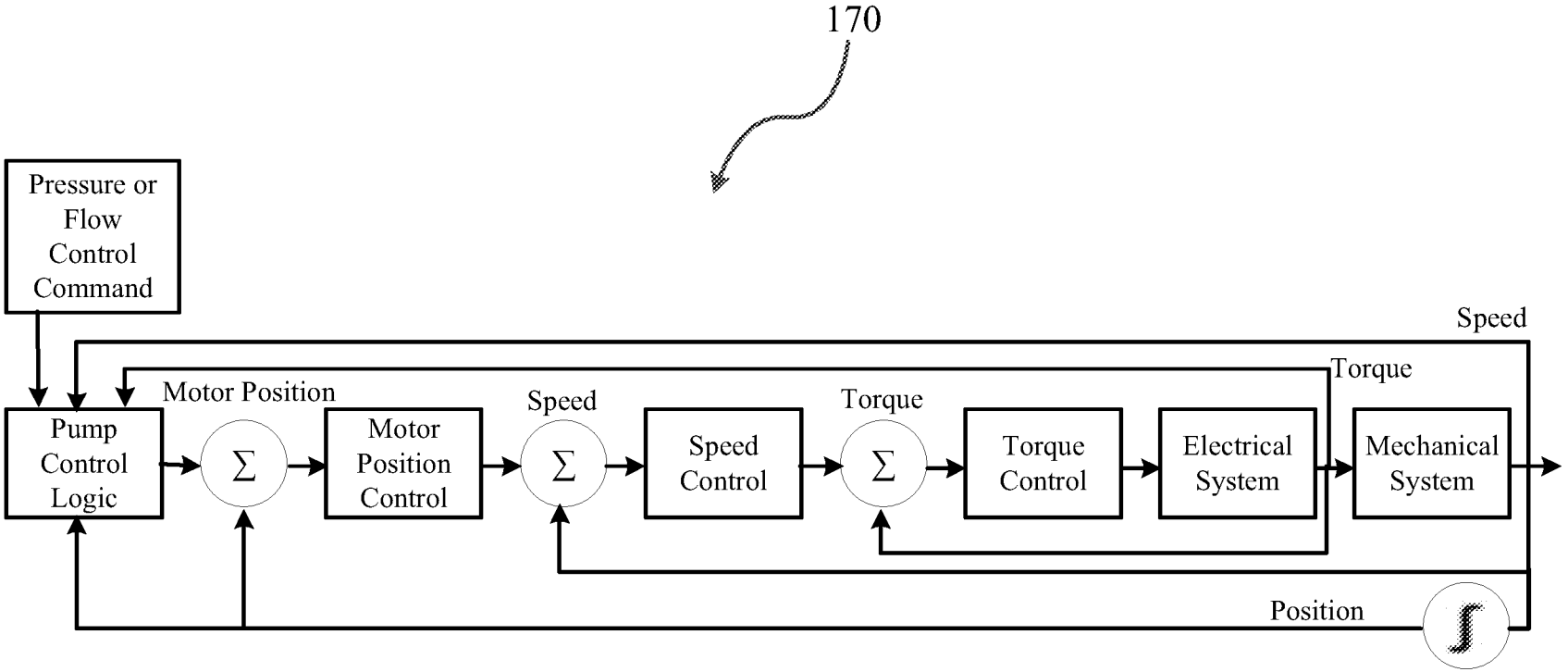
FIG. 10 is a block diagram of a non-limiting exemplary embodiment of a control loop for operating the pump in the high pressure and the high flow regions.

FIG. 10 is a block diagram of a non-limiting exemplary embodiment of a control loop of the controller 170 for operating the pumping system 10 in one of the high pressure regions or in one of the high flow regions. The illustrated embodiment is directed to a pumping system 10 using an electric motor. In certain embodiments, several layers of feedback control loop may be implemented. In some embodiments, the pressure or flow control command is used as a set-point for the control logic. In certain embodiments, the control logic may be configured for using motor speed, motor torque, motor position, and pump position as inputs for decision making. In some embodiments, the control logic may control or output commands for controlling the motor position, motor speed, and motor torque. In a non-limiting exemplary embodiment, the control logic determines whether the eccentric 160 should run continuously as illustrated in FIG. 2 or only operate within certain ranges of rotation as illustrated in one or more of FIGS. 3 through 6. In some embodiments, the controller 170 is configured to measure motor current and measure or estimate the motor position and speed using components and/or methods well known in the art including, but not limited to, sensor-less control algorithms, encoders, feedback loops, hall sensors, among others. In certain embodiments, the controller 170 is configured to ascertain the position of the drive shaft 150 using components and/or methods well known in the art including, but not limited to, sensor-less control algorithms, e.g., via motor current and speed measurements and estimates, and clocking signals from an external position sensor.

In view thereof, modified and/or alternate configurations of the embodiments described herein may become apparent or obvious to one of ordinary skill. All such variations are considered as being within the metes and bounds of the instant disclosure. For instance, while reference may have been made to particular feature(s) and/or function(s), the disclosure is considered to also encompass any and all equivalents providing functionalities similar to those disclosed herein with reference to the accompanying drawings. Accordingly, the spirit, scope and intent of the instant disclosure is to embrace all such variations. Consequently, the metes and bounds of the instant disclosure are defined by the appended claims and any and all equivalents thereof.

What is claimed is:

1. A pumping system, comprising:
a piston disposed within a piston cylinder;
a motor;
a drive shaft that is driven by the motor;
an eccentric coupled to the drive shaft;
a connecting arm comprising opposing first and second ends, wherein the first end of the connecting arm and the piston are coupled to each other; and the second end of the connecting arm and the eccentric are coupled to each other; and
a controller for controlling the motor based upon position, rotational speed, and torque, such that the drive shaft alternately rotates in a first direction and a second opposite direction and the eccentric oscillates the piston within a region selected from a group consisting of:
a first high pressure region (between $HP_1$ and $HP_3$);
a second high pressure region (between $HP_4$ and $HP_6$);
a first high flow region (between $HF_1$ and $HF_3$); and
a second high flow region (between $HF_4$ and $HF_6$),
wherein the controller limits rotational speed of the drive shaft while allowing torque to reach an upper limit when the region selected is the first high pressure region or the second high pressure region; and
wherein the controller limits the torque of the drive shaft while allowing rotational speed to reach a speed limit when the region selected is the first high flow region or the second high flow region.

2. The pumping system of claim 1, wherein
each of the first and the second high pressure region corresponds to a region of maximum relative mechanical advantage; and
each of the first and the second high flow region corresponds to a region of minimum relative mechanical advantage.

3. The pumping system of claim 2, wherein a flow rate of a material through the pumping system is substantially consistent in the region of minimum relative mechanical advantage.

4. The pumping system of claim 1, wherein
the first and the second high pressure regions are opposite each other; and
the first and the second high flow regions are opposite each other.

5. The pumping system of claim 4, wherein
the first high pressure region corresponds to an oscillation of the eccentric about a 12 o'clock position;
the second high pressure region corresponds to the oscillation of the eccentric about a 6 o'clock position;
the first high flow region corresponds to the oscillation of the eccentric about a 3 o'clock position; and
the second high flow region corresponds to the oscillation of the eccentric about a 9 o'clock position.

6. The pumping system of claim 1, wherein the controller limits the rotation of the drive shaft to less than one revolution.

7. The pumping system of claim 1, wherein the controller alternates the direction of rotation of the drive shaft between two pre-determined positions.

8. A pumping system, comprising:
a piston disposed within a piston cylinder;
a motor;
a drive shaft that is driven by the motor;
an eccentric coupled to the drive shaft;
a connecting arm comprising opposing first and second ends, wherein:
the first end of the connecting arm and the piston are coupled to each other; and
the second end of the connecting arm and the eccentric are coupled to each other; and
a controller for controlling the motor based upon rotational speed and torque of the drive shaft by limiting one of rotational speed or torque, such that the drive shaft alternately rotates in a first direction and a second opposite direction;
wherein the eccentric oscillates the piston within a region of maximum relative mechanical advantage when the controller limits the rotational speed of the drive shaft while allowing torque to reach an upper limit; and
wherein the eccentric oscillates the piston within a region of minimum relative mechanical advantage when the controller limits the torque of the drive shaft while allowing rotational speed to reach a speed limit.

9. The pumping system of claim 8, wherein
the region of maximum relative mechanical advantage corresponds to a high pressure region; and
the region of minimum relative mechanical advantage corresponds to a high flow region.

10. The pumping system of claim 8, wherein
the region of maximum relative mechanical advantage comprises opposing first and second high pressure regions; and
the region of minimum relative mechanical advantage comprises opposing first and second high flow regions.

11. The pumping system of claim 10, wherein the piston is oscillated in one of:
the first high pressure region;
the second high pressure region;
the first high flow region; and
the second high flow region.

12. The pumping system of claim 10, wherein
the first high pressure region corresponds to an oscillation of the eccentric about a 12 o'clock position;
the second high pressure region corresponds to the oscillation of the eccentric about a 6 o'clock position;
the first high flow region corresponds to the oscillation of the eccentric about a 3 o'clock position; and
the second high flow region corresponds to the oscillation of the eccentric about a 9 o'clock position.

13. The pumping system of claim 8, wherein the controller alternates a rotation of the drive shaft between two pre-determined positions.

14. A method of operating a pumping system in a region of high pressure, wherein:
the pumping system comprises:
a piston disposed within a piston cylinder;
a motor;
a drive shaft that is driven by the motor;
an eccentric coupled to the drive shaft;

a connecting arm comprising opposing first and second ends, wherein the first end of the connecting arm and the piston are coupled to each other; and the second end of the connecting arm and the eccentric are coupled to each other; and a controller that controls operation of the motor;

wherein the method comprises oscillating rotation of the drive shaft in opposing directions based upon a plurality of commands by the controller to the motor to:

rotate the drive shaft in a first direction whereby a torque and a rotational speed of the drive shaft increase;

limit the rotational speed of the drive shaft to a level less than a maximum speed limit while allowing torque to reach an upper limit;

stop rotation of the drive shaft in the first direction when the rotational speed reaches a minimum speed limit;

rotate the drive shaft in a second direction opposite the first direction whereby the torque and the rotational speed of the drive shaft increase;

limit the rotational speed of the drive shaft to a level less than a maximum speed limit while allowing torque to reach the upper limit; and stop rotation of the drive shaft in the second direction in response to the rotational speed reaching the minimum speed limit.

15. The method of claim 14, wherein the pumping system is operated in a region of maximum relative mechanical advantage.

16. The method of claim 14, wherein operating the pumping system in the region of high pressure comprises operating the pumping system in one of two opposing regions of high pressure.

17. The method of claim 16, wherein operating the pumping system in one of two opposing regions of high pressure comprises oscillating the eccentric about one of a 12 o'clock position and a 6 o'clock position.

18. A method of operating a pumping system in a region of high flow, wherein:

the pumping system comprises:

a piston disposed within a piston cylinder;

a motor;

a drive shaft that is driven by the motor;

an eccentric coupled to the drive shaft;

a connecting arm comprising opposing first and second ends, wherein the first end of the connecting arm and the piston are coupled to each other; and the second end of the connecting arm and the eccentric are coupled to each other; and a controller that controls operation of the motor;

wherein the method comprises oscillating rotation of the drive shaft in opposing directions based upon a plurality of commands by the controller to the motor to:

rotate the drive shaft in a first direction whereby a torque and a rotational speed of the drive shaft increase;

limit the torque of the drive shaft to a level less than a maximum torque threshold while allowing rotational speed to reach a maximum speed limit;

stop rotation of the drive shaft in the first direction when the torque reaches a minimum torque threshold;

rotate the drive shaft in a second direction opposite the first direction whereby the torque and the rotational speed of the drive shaft increase;

limit the torque of the drive shaft to a level less than the maximum torque threshold while allowing rotational speed to reach the maximum speed limit; and stop rotation of the drive shaft in the second direction in response to torque reaching the minimum torque threshold.

19. The method of claim 18, wherein the pumping system is operated in a region of minimum relative mechanical advantage.

20. The method of claim 18, wherein operating the pumping system in the region of high flow comprises operating the pumping system in one of two opposing regions of high flow.

21. The method of claim 20, wherein operating the pumping system in one of two opposing regions of high flow comprises oscillating the eccentric about one of a 3 o'clock position and a 9 o'clock position.

* * * * *